US005219459A

United States Patent [19]

Kaneko

[11] Patent Number: 5,219,459

[45] Date of Patent: Jun. 15, 1993

[54] LATCH CONNECTOR

[75] Inventor: Tetsuya Kaneko, Tokyo, Japan

[73] Assignee: Yamaichi Electric Co., Ltd., Tokyo, Japan

[21] Appl. No.: 799,992

[22] Filed: Nov. 29, 1991

[30] Foreign Application Priority Data

Nov. 30, 1990 [JP] Japan ..... 2-130119

[51] Int. Cl.[5] ..... H01R 13/62

[52] U.S. Cl. ..... 439/157; 439/153

[58] Field of Search ..... 439/152-160, 439/350-358

[56] References Cited

U.S. PATENT DOCUMENTS

| | | | |
|---|---|---|---|
| 4,178,051 | 12/1979 | Kocher et al. | 439/157 |
| 4,579,408 | 4/1986 | Sasaki | 439/157 |
| 4,768,967 | 9/1988 | Fritsch | 439/152 |
| 4,973,255 | 11/1990 | Rudoy | 439/160 |
| 5,017,149 | 5/1991 | Hatanaka | 439/157 |

*Primary Examiner*—David L. Pirlot
*Attorney, Agent, or Firm*—Wenderoth, Lind & Ponack

[57] ABSTRACT

A latch connector has a first connector and a second connector. The first connector has a pair of latches disposed on opposing lateral ends thereof, each of which is pivotably supported by a shaft. Each latch has an upper claw and a lower claw. The second connector has hook portions disposed on opposing lateral ends thereof which are brought into engagement with the lower claws to cause the first and second connectors to be connected with each other when the latches are pivoted in the opening direction, and pressure receiving portions which the upper claws are urged against to exert a force for separating the first and second connectors when the latches are pivoted in the closing direction, when the lower claw and the hook portion are disengaged from each other. When the first connector is pushed into the second connector, the latch is pivoted in the opening direction by the upper claw being urged against by the pressure receiving portion to achieve an engagement between the lower claw and the hook portion. The second connector has a cam for causing the latch to be pivoted in the closing direction. The latch has a slider which is guided by the cam. The latch is pivoted in the closing direction by the slider sliding along the contour of the cam when the first connector is pushed into the second connector.

6 Claims, 6 Drawing Sheets 11
12
13
16
17
20
21
23

LATCH CONNECTOR

BACKGROUND OF THE INVENTION

1. Field of the Invention

This invention relates to an improvement of a latch connector, in which a first connector is provided with a pair of latches adapted to connect the first connector to a second connector and to remove the engaging relation therebetween.

2. Brief Description of the Prior Art

A conventional latch connector is constituted such that a latch 1 as shown in FIG. 6 is mounted on each lateral end portion of a first connector 2 and is pivotably supported by a shaft 3 for pivotal movement in opposite directions. The arrangement is such that when each latch 1 is pivoted in an opening direction, a lower claw 6 of the latch 1 is brought into engagement with one of a pair of hooks 7 disposed on opposing lateral ends of a second connector 4 from thereunder to realize a connecting relation between the first and second connectors 2 and 4. When the latch 1 is pivoted in a closing direction when the first and second connectors 2 and 4 are in their connecting relation, the engagement between the lower claw 6 and the hook 7 is removed. At the same time, the lower claw 6 of the latch 1 pushes against a pressure receiving portion 8 formed of a head portion of the hook 7 and, as a reaction thereto, a force for separating the first and second connectors 2 and 4 is exerted against the first and second connectors 2 and 4 in order to remove the connecting relation. To realize the connecting relation again from such disconnected state, the latch 1 is first pivoted in the closing direction as shown by solid lines in FIG. 6(B) to release the lower claw 6 so that the claw 6 does not interfere with the hook 7. Then, the first connector 2 is pushed into the second connector 4. During the course of this pushing-in operation, the upper claw 5 is urged against the pressure receiving portion 8 to cause the latch 1 to be pivoted in the opening direction. As a result, an automatic engagement is achieved between the lower claw 6 and the hook 7.

In the conventional connector, whenever the first connector 2 is pushed into the second connector, it is required to check whether or not each latch 1 is positioned in the closing position. In the event the latch 1 is positioned in the opening position as indicated by broken lines in FIG. 6(B), it is necessary to manually move the latch 1 back to the closing position as indicated by the solid lines and thereafter, the first connector 2 can be pushed into the second connector 4.

The reason is as follows. If it is attempted to push the first connector 2 into the second connector 4 when the latch 1 is already in the opening position as shown in FIG. 6(A), the lower claw 6 interferes the pressure receiving portion 8 and a reverse force for pivoting the latch 1 in the opening direction about the shaft 3 is generated to create a dead lock state (a state in which the first connector 2 cannot be pushed into the second connector 4).

For example, when the first connector 2 is pushed into the second connector 4 while the pair of latches are held with fingers, the latches 1 can be pivoted into the closing positions. However, when the upper claws 5 are urged against the pressure receiving portions 8 such that a force is produced which would normally cause pivoting of the latches 1 in the opening direction, the pivotal movement of the latch 1 in the opening direction can be disturbed by the force of the finger holding the latch 1, with the result that the aforementioned connecting relation is not obtained.

The features of a latch connector of this type reside in the fact that the first and second connectors can be automatically locked by pushing the first connector into the second connector without holding the latches. However, the conventional latch connector has the disadvantage that when the first connector is pushed into the second connector without noticing the fact that the latches are already disposed in the opening position, the connecting relation is unobtainable for the aforementioned reasons. The conventional latch connector also has the disadvantage that whenever the first connector is pushed into the second connector, it is necessary to check whether the latches are in the closing positions and to correct the attitudes of the latches (i.e. to bring the latches back into the closing positions) if they are not.

SUMMARY OF THE INVENTION

It is therefore a general object of the present invention to provide a latch connector which is capable of adequately overcoming the abovementioned disadvantages and in which first and second connectors can automatically be locked without the need to check or correct the attitudes of the latches irrespective of their positions.

In order to achieve the above object, there is essentially provided a latch connector having a first connector and a second connector, the first connector being provided at opposing lateral end portions thereof with a pair of latches which are pivotably supported for pivotal movement in opposing latching and unlatching directions. Each of the latches includes an upper claw and a lower claw. The second connector is provided at opposing lateral end portions thereof with hook portions which are brought into engagement with the lower claws from thereunder to cause the first and second connectors to be connected with each other when the latches are pivoted in the latching directions, and pressure receiving portions which are urged by the upper claws to exert a force for separating the first and second connectors when the latches are pivoted in the unlatching directions and the lower claws and hook portions are disengaged from each other. When the first connector is pushed into the second connector, the latches are pivoted in the latching directions by the upper claws being pressed upwardly by the pressure receiving portions, to achieve an engagement between the lower claws and the hook portions. The second connector is provided with cams adapted to cause the latch to be pivoted in the unlatching directions. The latches are provided with sliders which are guided by the cams, such that the latches are pivoted in the unlatching directions by the sliders sliding along the contours of the cams when the first connector is pushed into the second connector.

As described above, according to the present invention, when the first connector is pushed into the second connector, the slider of each latch is guided by the cam to automatically correct the attitude of each latch to pivot it in the unlatching direction. Accordingly, a released state is correctly formed with respect to the hook portion, and the upper claw is urged against the pressure receiving portion by means of the subsequent pushing-in operation. As a result, the latch is caused to be pivoted in the latching direction and is brought into engagement with the hook. By this, the so-called automatic locking operation is correctly carried out. It is no longer necessary to check the attitude of each latch whenever the first connector is pushed into the second connector. It is no longer necessary to correct the attitude of each latch by finger. There can also be effectively obviated such disadvantage that the first and second connectors cannot be connected with each other because the latches are not in their unlatching positions.

The above and other objects and attendant advantages of the present invention will be apparent to those skilled in the art from a reading of the following description and claims in conjunction with the accompanying drawings which constitute a part of this disclosure.

DETAILED DESCRIPTION OF THE EMBODIMENT

Figure 1:
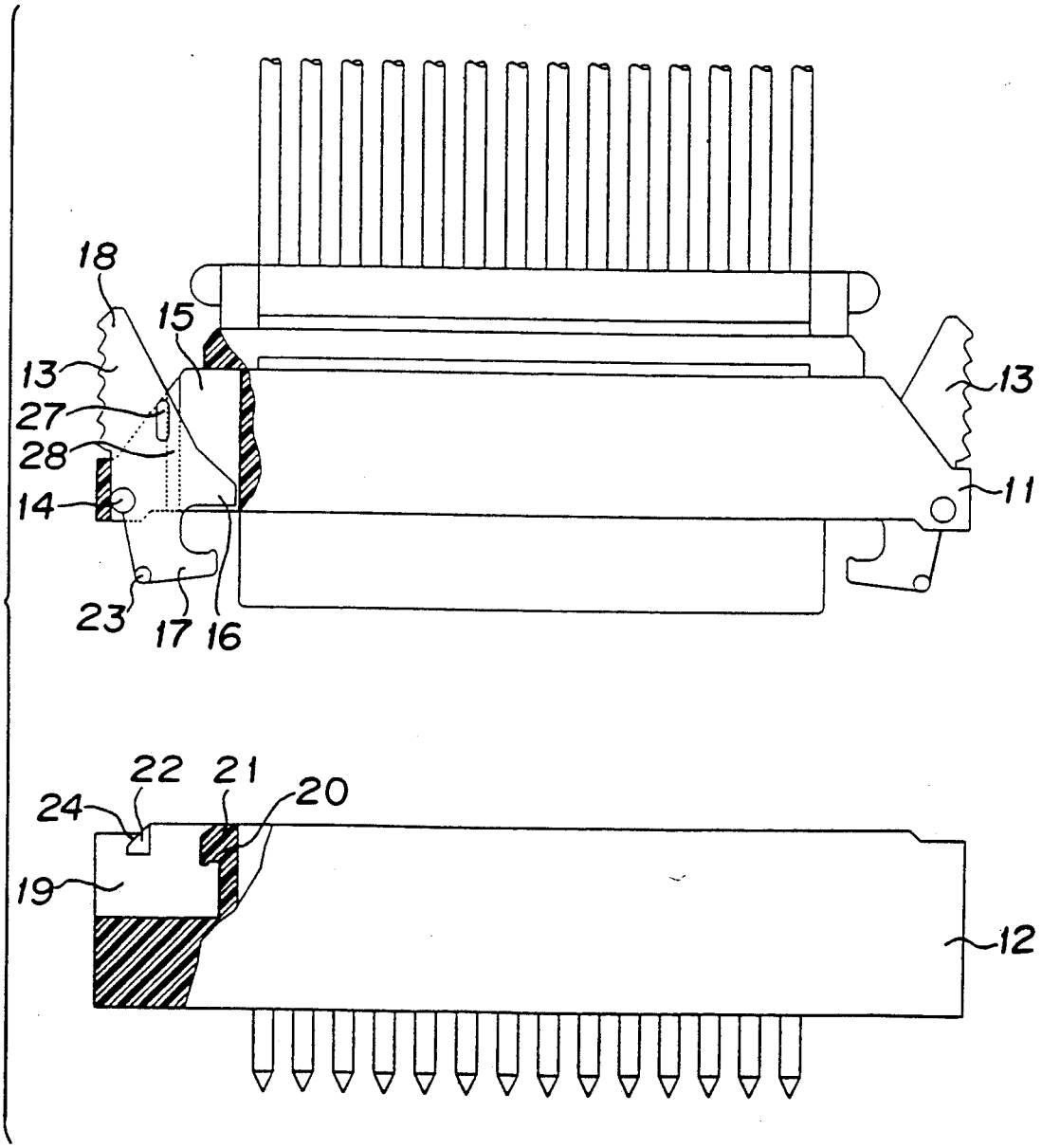
FIG. 1 is a partly cut-away side view of a latch connector according to one embodiment of the present invention, showing non-connected relationship between a first connector and a second connector.
Figure 2:
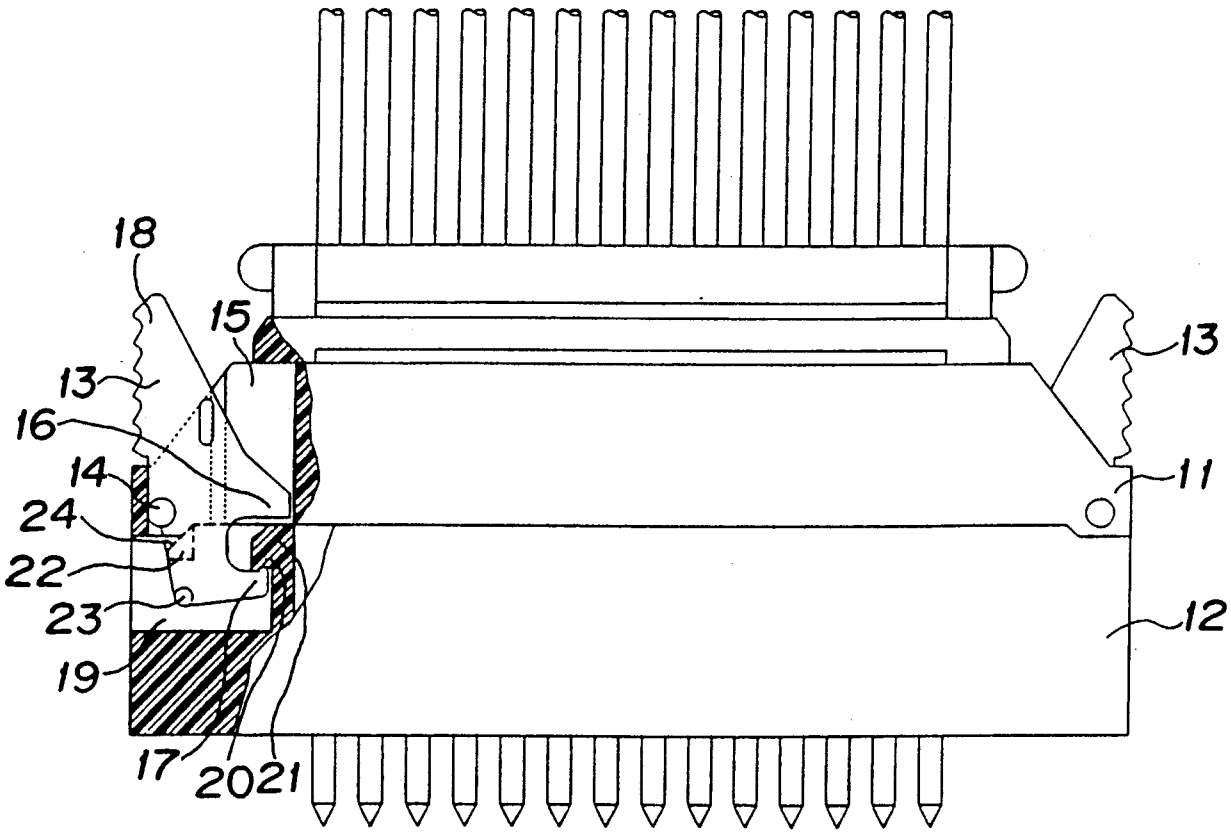
FIG. 2 is a front view of the above, but showing a connected relationship between the first and second connectors.

One embodiment of the present invention will now be described with reference to FIGS. 1 through 5 of the accompanying drawings.

The numeral 11 denotes a first connector connected with, for example, a terminal of a cable, and 12 denotes a second connector. The first connector 11 has a pair of latches 13 pivotably supported on both lateral ends thereof for pivoting in opposite directions about shafts 14.

The first connector 11 is provided at both lateral end portions thereof with an accommodating portion 15, respectively, which is adapted to accommodate each latch 13. Each latch 13 accommodated in the accommodating portion 15 is journaled to a wall defining the accommodating portion 15. The latch 13 is provided with an upper claw 16 and a lower claw 17 projecting in opposing directions. The lower claw 17 projects downwardly from a lower end portion of a latch portion extending downwardly from the shaft 14. This lower claw 17 is allowed to project downwardly through a lower opening of the accommodating portion 15. The upper claw 16 is projected in the direction opposite the lower claw 17. This upper claw 16 is arranged such that it is brought in and out through the lower opening of the accommodating portion 15 upon pivotal movement of the latch 13. An operating portion 18 extending upwardly from the shaft 14 is projected upward through an upper opening portion of the accommodating portion 15.

On the other hand, the second connector 12 is provided at each lateral end portion thereof with a receiving portion 19 for receiving a lower end portion of the latch 13. The receiving portion 19 is provided therein with a hook 20 erected therefrom and adapted to engage with the lower claw 17 from thereunder. The hook 20 is provided with a pressure receiving portion formed on a head portion thereof and is adapted to bear against the upper claw 16 when the upper claw 16 is urged thereagainst.

The lower claw 17 is brought into engagement with a hook portion 21 from thereunder when the latch is pivoted in the opening (or latching) direction. The upper claw 16 is urged against the pressure receiving portion when the pivoting latch is caused to be pivoted in the closing (or unlatching) direction by a finger, and as a reaction thereto, a force for separating the first and second connectors 11 and 12 is generated to separate them from each other. The concept of the expression "separating" used here is broad. It includes not only a state where the first and second connectors are completely separated from each other but also a semi-separated state where the first and second connectors are slightly pulled away from the final connected position.

The upper claw 16 is urged against the pressure receiving portion 21 when the first connector 11 is pushed into the second connector 12, and as a reaction thereto, the latch 13 is forced to pivot in the opening direction and the lower claw 17 is engaged with the hook 20 from thereunder, to thereby form the aforementioned locked state.

Between a side wall of the accommodating portion 15 and a side surface of the latch 13, there is provided a braking portion comprising projecting elements 27, 28, etc., so that a pivotal position in the opening direction can be maintained by the projecting element 27 of the latch 13 having climbed over the other projecting element 28 inwardly.

The receiving portion 19 of the second connector 12 is provided on an inner surface of the side wall thereof with a cam 22 adapted to cause the latch 13 to be pivoted in the closing direction. The latch 13 is provided on a lower end thereof with a slider 23 to be guided by the cam 22. The arrangement being such that when the first connector 11 is pushed into the second connector 12, the slider 23 is slid along the profile of cam 22 to cause the latch 13 to be pivoted in the closing direction.

Each cam 22 has an inclined surface spreading downwardly. The inclined surface is located generally right under a pivotal fulcrum of the latch 13 and spaced apart forwardly from the outside of the hook 20 so that the inclined surface is at generally the same level as or is slightly higher than the hook 20. On the other hand, the slider 23 is located generally right under the pivotal fulcrum of the latch 13 and spaced apart rearwardly from the outside of the lower claw 17 such that the slider 23 is at the same level as the lower claw 17.

The cam 22 is formed of a lug having an inclined surface 24 as shown in FIGS. 1 through 4. In other examples, the cam 22 can be formed of a grooved cam or projection in which an introducing portion formed at an inner surface of the side wall of the receiving portion 19 has a generally horizontal V-shaped groove or surface 25 as shown in FIG. 5(A), or otherwise it can be formed of a projection having an arcuate surface 26 as shown in FIG. 5(B).

The action of the latch connector will be described, and during the description, the constitution of the latch connector will be made clearer. FIGS. 3(A) through 3(D) are illustrations for explaining the sequence in which the first connector 11 is pushed into the second connector 12.

Figures 3A, 3B, 3C, 3D:
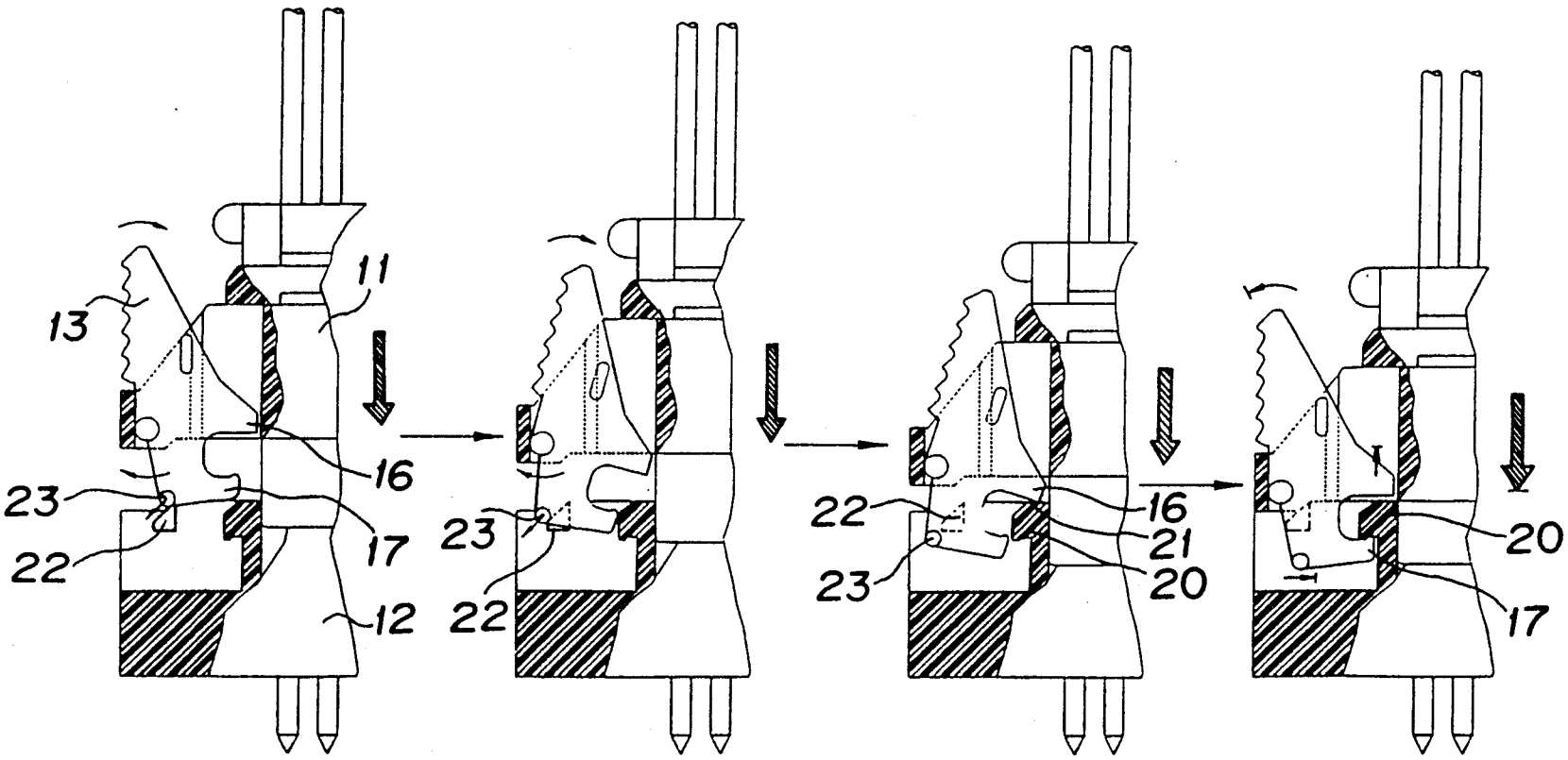
FIGS. 3(A) through 3(D) are partly cut-away front views of an important part of the latch connector, for explaining the steps for connecting the first and second connectors.
Figure 4:
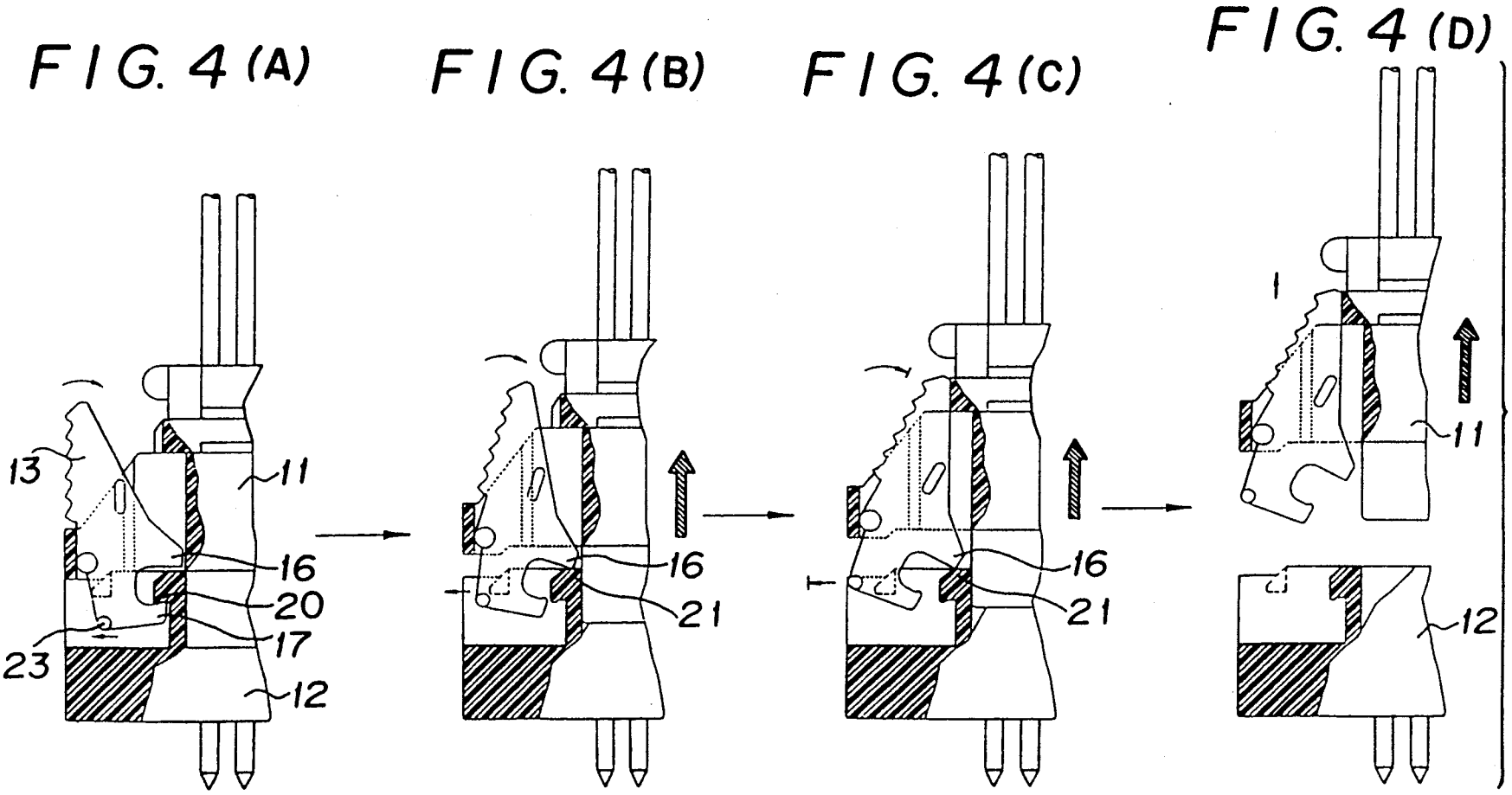
FIGS. 4(A) through 4(D) are partly cut-away front views of an important part of the latch connector, for explaining the steps for disconnecting the first and second connectors.
Figure 5:
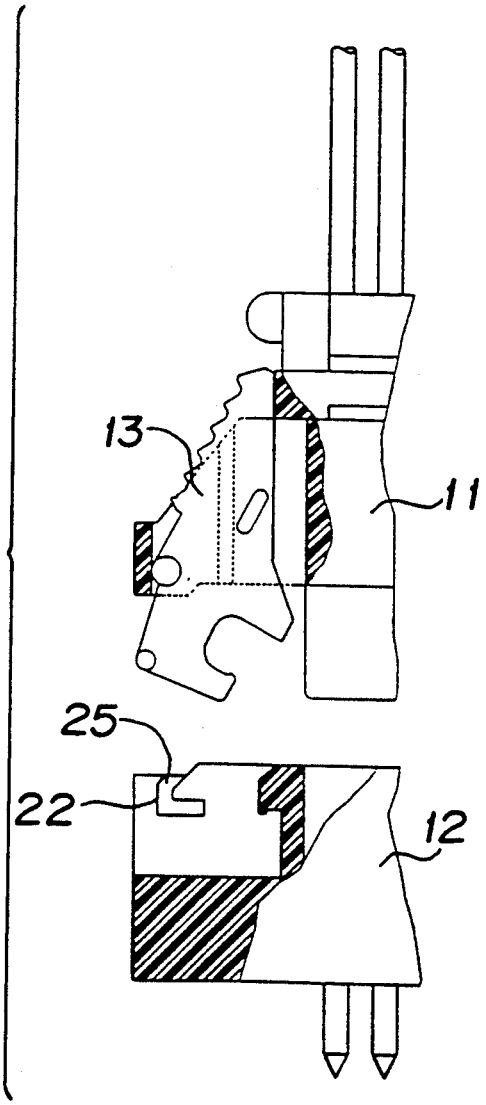
FIGS. 5(A) and 5(B) are partly cut-away front views of an important part of the latch connector, showing other examples of a cam.
Figure 5:
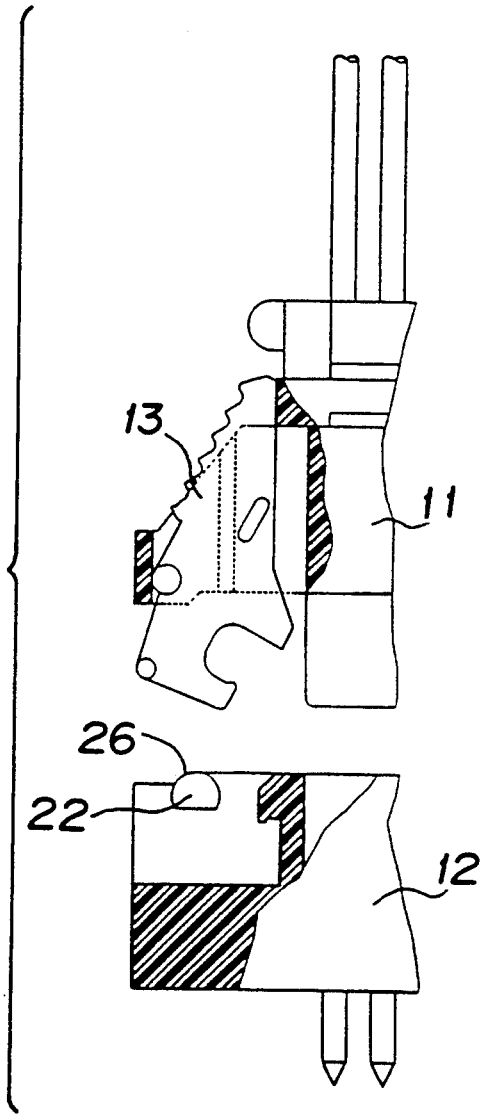
Figure 6:
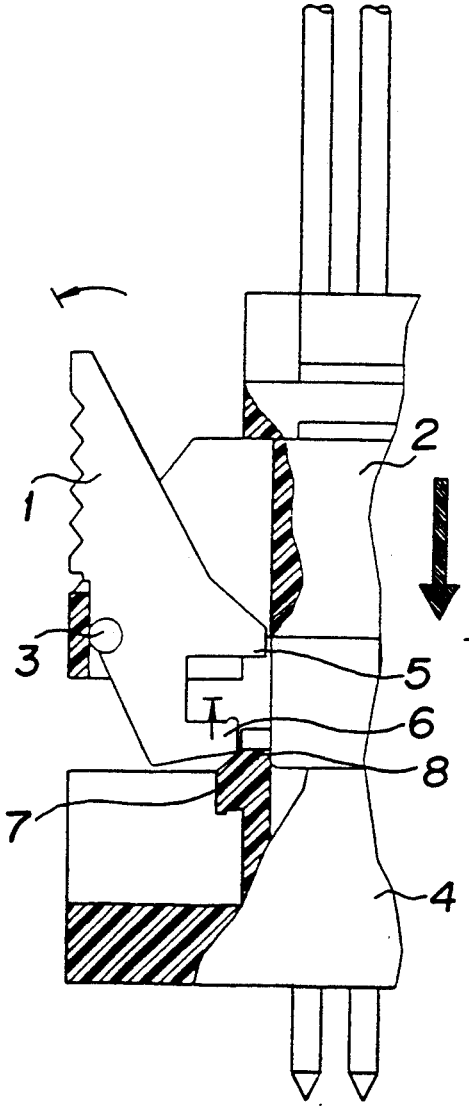
FIG. 6 (A) PRIOR ART
FIGS. 6(A) and 6(B) are partly cut-away front views of an important part of a conventional latch connector.
Figure 6:
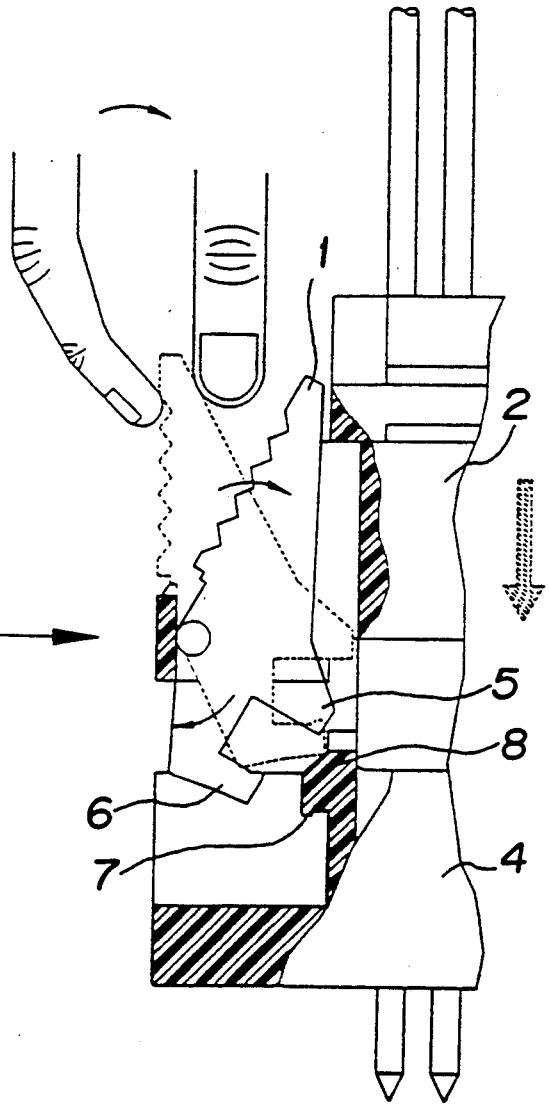
FIG. 6 (B) PRIOR ART

As is shown in FIG. 3(A), while the first connector 11 is being pushed into the second connector 12, the slider 23 hits the inclined surface 24 of the cam 22 and slides therealong. As a result, the latch 13 is forced to be pivoted in the closing direction as shown in FIG. 3(B). In a position where the slider 23 is free from the cam 22, the upper claw 16 is urged against the pressure receiving portion 21 as shown in FIG. 3(C). When the first connector 11 is further pushed into the second connector 12 in the foregoing state, the upper claw 16 is pushed upwardly against by the pressure receiving portion 21, and the latch 13 is caused to be pivoted in the opening direction. In accordance with the pivotal movement of the latch 13 in the opening direction, the lower claw 17 is brought into engagement with the hook 20 from thereunder as shown in FIG. 3(D). That is, an automatic locking operation is carried out and a connecting relation is accomplished between the first and second connectors 11 and 12.

Next, operation for removing the first connector 11 from the second connector 12 will be described with reference to FIGS. 4(A) through 4(D). As shown in FIG. 4(A), the first and second connectors 11 and 12 are in a connected relation as described with reference to FIG. 3(D). In that state, when the operating portions 18 of the pair of latches 13 are each held between the thumb and the index finger, the latch 13 is pivoted in the closing direction as shown in FIG. 4(B), and the lower claw 17 and the hook 20 are disengaged from each other. When the pivotal movement of the latch 13 is further progressed in the closing direction by the finger pressure, the upper claw 16 is urged against the pressure receiving portion 21 as shown in FIGS. 4(B) and 4(C), and a force for pulling the first and second connectors 11 and 12 apart is generated. As a result, the first connector 11 is completely separated from the second connector 12.

Once the first and second connectors are separated from each other as shown in FIG. 4(D), the first connector 11 can easily be removed.

As described in the foregoing, when the first connector is pushed into the second connector for interconnection, without any requirement for checking whether or not the attitude (or orientation) of the latch is in its closing position or for correcting its attitude, a non-interference state between the lower claw and the hook can be reliably realized owing to the action of the cam means simply by holding the first connector and pushing it into the second connector irrespective of the attitude of the latch, and it is unnecessary to check the orientation thereof. The subsequent pivotal movement in the opening direction of the latch as well as the engagement between the lower claw and the hook are correctly attained by the upper claw and the pressure receiving portion. As a result, a correct automatic locking operation can be carried out.

Therefore, according to the present invention, there can be provided a latch connector which is convenient to use and in which there is no fear that the first and second connectors will be improperly connected with each other, and it is no longer required that the attitude of the latch be checked or to force the latch to be pivoted.

Although the present invention has been described in its preferred form, it is understood that the present disclosure of the preferred form has been made only by way of example and that numerous changes in the details of construction and arrangement of parts may be resorted to by those skilled in the art without departing from the spirit and the scope of the invention as hereinafter claimed.

What is claimed is:

1. A latching device comprising:

a first connector;

a pair of latches mounted to said first connector at opposing ends thereof, respectively, each of said latches being pivotably mounted to said first connector for pivotal movement about a pivot axis in opposing latching and unlatching directions between latching and unlatching positions, each of said latches including an upper claw, a lower claw and a slider;

a second connector adapted to be mounted to said first connector from below;

a pair of cams disposed at opposing ends of said second connector, respectively, said cams defining means for engaging and guiding said sliders to force said latches to pivot in said unlatching directions as said first connector is moved toward said second connector;

a pair of pressure receiving portions disposed at said opposing ends of said second connector, respectively, said pressure receiving portions defining means for pressing upwardly against said upper claws to cause pivoting of said latches in said latching directions when said first connector is moved toward said second connector;

a pair of hook portions disposed at said opposing ends of said second connector, respectively, said hook portions defining means for engaging said lower claws from below when said first connector is mounted to said second connector and said latches are in said latching positions; and wherein said upper claws define means for pressing against said pressure receiving portions to force said first connector to separate from said second connector when said latches are pivoted in unlatching directions from said latched positions.

2. A latching device as recited in claim 1, wherein said cams are spaced away from said hooks and are positioned at substantially the same height as or are slightly higher than said hooks, respectively.

3. A latching device as recited in claim 2, wherein said cams are substantially vertically aligned with said pivot axes of said latches, respectively, when said first connector is latched to said second connector.

4. A latching device as recited in claim 3, wherein in said unlatched positions of said latches, said sliders are substantially vertically aligned with said pivot axes, and are at substantially the same height as said lower claws, respectively.

5. A latching device as recited in claim 1, wherein said lower claws extend downwardly of said pivot axes, respectively.

6. A latching device as recited in claim 5, wherein said latches further includes operating portions extending upwardly of said pivot axes, respectively, for permitting said latches to be manually pivoted about said pivot axes.

* * * * *